United States Patent [19]

Stevenson

[11] 4,077,520

[45] Mar. 7, 1978

[54] RACKS FOR CARDS AND THE LIKE

[76] Inventor: Sydney Samuel Stevenson, "Oakland", Knoll Rd., Godalming, Surrey, England

[21] Appl. No.: 635,390

[22] Filed: Nov. 26, 1975

[30] Foreign Application Priority Data

Nov. 27, 1974 United Kingdom ..... 51443/74

[51] Int. Cl.[2] ..... A47F 7/00; G09F 1/10

[52] U.S. Cl. ..... 211/55; 40/124.2; 312/183

[58] Field of Search ..... 211/50–56, 211/45, 46, 184; 312/114, 117, 118, 119, 120, 122, 123, 125–136, 183, 184, 193, 185, 234; 108/61, 91, 92, 93, 96, 101, 106, 144; 40/124, 124.2, 105

[56] References Cited

U.S. PATENT DOCUMENTS

| | | | |
|---|---|---|---|
| 562,933 | 6/1896 | Stone | 211/55 |
| 776,569 | 12/1904 | Wade | 211/50 |
| 1,525,318 | 2/1925 | Payzant | 211/50 |
| 1,592,596 | 7/1926 | Bates | 211/55 |
| 1,594,754 | 8/1926 | Reines | 211/55 |
| 1,741,560 | 12/1929 | Engel | 211/55 |
| 1,997,829 | 4/1935 | McKee | 211/55 |
| 2,443,320 | 6/1948 | Meyer et al. | 211/56 |
| 2,757,727 | 8/1956 | Findell | 160/168 |
| 2,981,019 | 4/1961 | Baird | 40/124 |

*Primary Examiner*—Roy D. Frazier
*Assistant Examiner*—Terrell P. Lewis
*Attorney, Agent, or Firm*—Mason, Kolehmainen, Rathburn & Wyss

[57] ABSTRACT

A vertical storage rack for cards or the like comprises a casing means carried by the casing for forming a plurality of downwardly-extending pockets which overlap each other from front to back and have openings one above the other at the front of the rack and means for supporting the bottom edges of the cards in the pockets at levels which can be decided by the user either by adjusting the depths of the pockets or by inserting the cards against selected parts of the pocket. Preferably each pocket is formed of a sheet of flexible material the front edge of which is fixed and forms the bottom edge of the pocket opening and the rear edge of which is supported by adjusting means which can be operated to raise or lower the back of the pocket and thus adjust its depth. Vertical dividing members are movable between different positions along the pockets and divide the latter into individual pockets the width of which can be adjusted.

9 Claims, 8 Drawing Figures

RACKS FOR CARDS AND THE LIKE

BACKGROUND AND SUMMARY OF THE INVENTION

This invention relates to racks for the storage of cards, information sheets, leaflets, folders or the like, or of other flat objects, all of which are included, where appropriate, in the term "cards" which will be used in the following description.

The invention has for its principal object the provision of such racks, which may be in the form of one or more units, in which such cards can be kept, and if desired displayed, in a way which will allow individual cards to be easily identified and removed as neccessary for reference or use.

Another object of the invention is the provision of such racks which can be adjusted to suit cards of different sizes.

A further object of the invention is a provision of such racks which include a number of pockets for holding the cards, which can be adjusted or used to hold cards, including documents or the like, of many different sizes. Such cards or documents can be used, for example, as aids to planning and recording the use of resources, whether manpower, machines or materials. The racks can be used for stock control, for the booking of space and/or time and for locating other documents or files, to give a number of examples.

As will appear from the following description the invention, in one of its aspects, makes use of pockets which are made of flexible material and are provided with means for adjusting their depths. It is also possible to use fixed pockets having either adjustable supports or a series of fixed supports on which the bottom edges of the cards are supported.

The invention, in one of its aspects, provides apparatus for storing and displaying cards, including information sheets or other documents or articles as referred to above, which apparatus comprises a number of pockets arranged one above the other, each of which pockets is formed of a sheet of flexible material which is supported at its front and back edges, means being provided for adjusting the effective length of the flexible material which forms the pocket so as to reduce or increase the depth of the latter.

Preferably the front edge of the material of each pocket is fixed to, or itself acts as, a fixed cross-bar and means are provided for moving the back edge of the material upwardly or downwardly to reduce or increase the depth of the pocket. Thus the rear edges of the material forming the pockets may be secured to a frame, plate or other member or to a number of members which can be moved upwardly or downwardly to vary the depths of the pockets simultaneously.

Alternatively the rear edges of the material of the pockets may be secured to rods or rollers which can be turned to reduce or increase the depths of the pockets. Belt or other drive connections are preferably provided so that the turning of one rod turns all the others, thus ensuring that the depths of the pockets are decreased or increased simultaneously.

Alternatively the pockets may have fixed front walls which are provided with means for supporting the lower edges of the cards at different levels. There may be a series of projections at different levels, the fronts of the pockets being inclined to the vertical, or supports for the cards may be provided which are adjustable up and down by suitable means.

According to another feature of the invention means are provided for adjusting the widths of the pockets. These may take the form of one or more dividing members the positions of which can be adjusted laterally, relatively to the widths of the pockets. The members are preferably removable so that unwanted ones can be kept separately for future use.

BRIEF DESCRIPTION OF THE DRAWINGS

The accompanying drawings show, largely diagrammatically, a number of embodiments of the invention. In the drawings.

Figure 1:
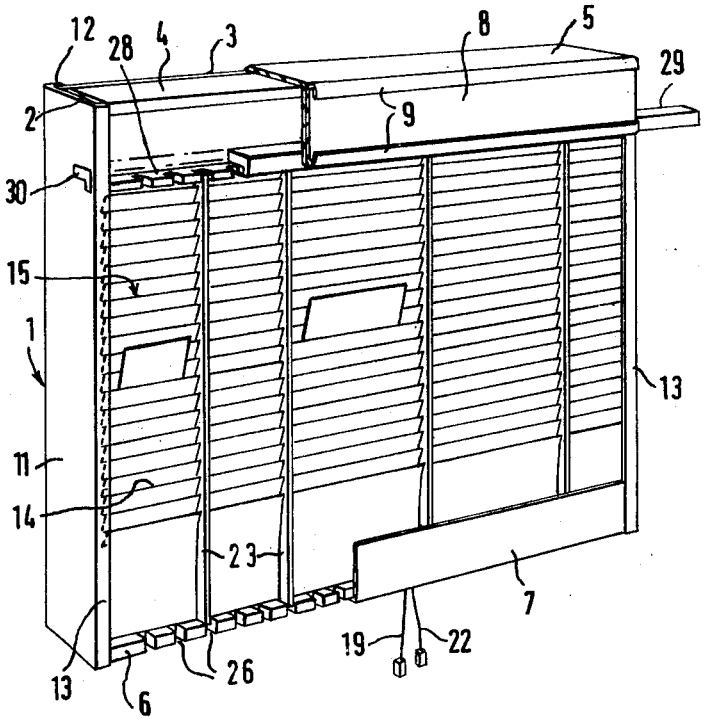
FIG. 1 is a general perspective view, partly broken away, showing one embodiment of the invention.
Figure 2:
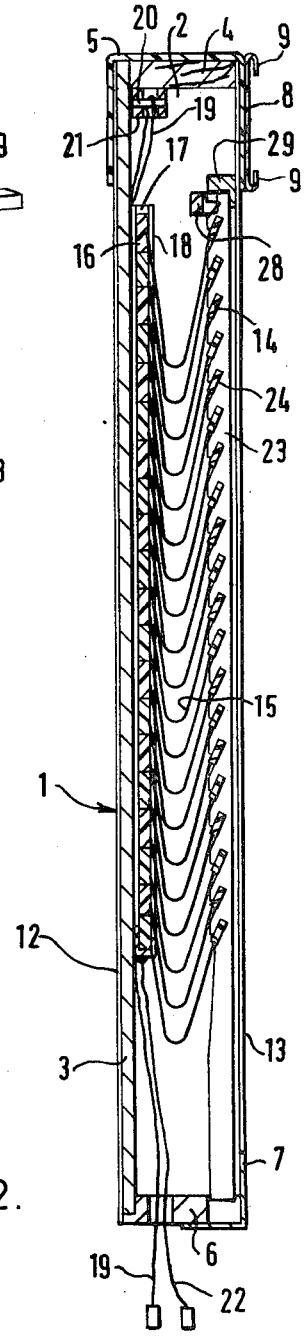
FIG. 2 is a vertical section, to a larger scale, taken through the rack shown in FIG. 1.

Referring first to FIGS. 1 and 2, the rack shown comprises a casing 1 having end walls 2, a back plate 3, a top 4 with a removable cover 5 and a bottom 6 with a front cover 7. These parts may be made of any suitable materials, including wood, metal and plastics but, to give an example, the ends 2, top 4 and bottom 6 can be of wood, the back 3 of ply-wood or fibreboard and the covers 5 and 7 of metal or a plastic. The cover 5 includes ends (not shown), which fit over the ends 2 of the casing, and a front 8 having a pair of channels 9 into which title boards can be inserted.

The front of the bottom cover 7 is upturned as shown and it may have a transparent facia fitted behind it to form receptacles in which relevant information can be displayed.

Metal side covers 11 cover the side walls 2. They have rear lips 12, which hold the back plate 3, and front lips 13, which help hold the front edges 14 of the pockets 15, as will be described.

The pockets 15 are formed of lengths of a suitable semi-flexible synthetic plastics material, the front edges 14 of which are thickened and supported by the end walls 2, which are formed with inclined slots into which projecting ends of the front edges 14 of the pockets engage, inside the lips 12. The rear edges 16 of the pockets 15 are also thickened and extended so that their ends engage in a frame 17, the sides 18 of which are of U-section to receive these ends. When all the pockets are in position, as shown in FIG. 2, their thickened rear edges fit one upon the other in the frame 17, which frame is pressed by the resiliency of the material of the pockets against the back plate 3. The frame 17 is movable up or down by suitable means which, in the construction shown, comprise a cord 19, which passes over a bar or pulley 20 in a block 21 attached to the top 4 and has its end connected to the top of the frame 17, and another cord 22 which is connected to the bottom of the frame 17.

The friction of the frame 17 against the back plate 3 will support it and the pockets 15 in their adjusted positions but the frame can be raised by means of the cord 19, so as to make the pockets 15 shallower, which may be done to fit them for shorter cards or so as to display more of the cards fitted in them, or the frame can be lowered to make the pockets deeper so that they can take longer cards and/or conceal more, or even the whole, of the cards in them.

The pockets 15 are also subdivided longitudinally by means of dividing strips 23, which may be made of a plastic or a metal. The strips 23 are formed with spaced slots 24, which engage the front edges 14 of the pockets 15, while their lower ends can be engaged in any of a number of notches 26 formed in the bottom 6 of the casing; a similarily notched member 28 is also provided for locating the upper ends of the strips 23.

The strips 23 are fitted by first introducing their lower ends into their selected notches 26, after which their upper ends are engaged in the correct notches in the member 28. The strips are then locked in position by sliding in a locking bar 29 which fits in the openings 30 formed in the end walls 2 and in their covers 11.

It is only necessary to fit the number of strips needed to effect the required subdivision.

Figure 3:
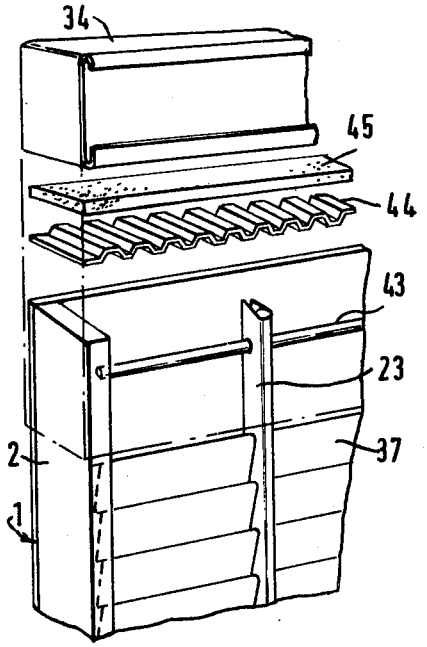
FIG. 3 is a view, from the front and one side, showing details of a modification with parts of the top of the rack removed.
Figure 5:
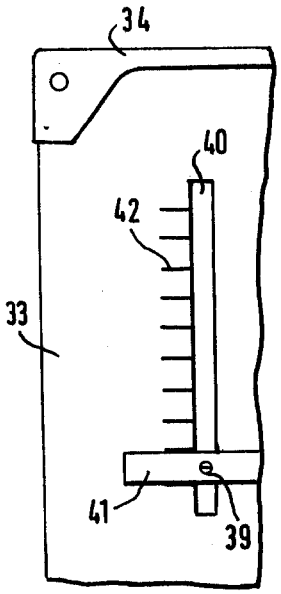
FIG. 5 is a detail view from the back of the rack shown in FIGS. 3 and 4.
Figure 4:
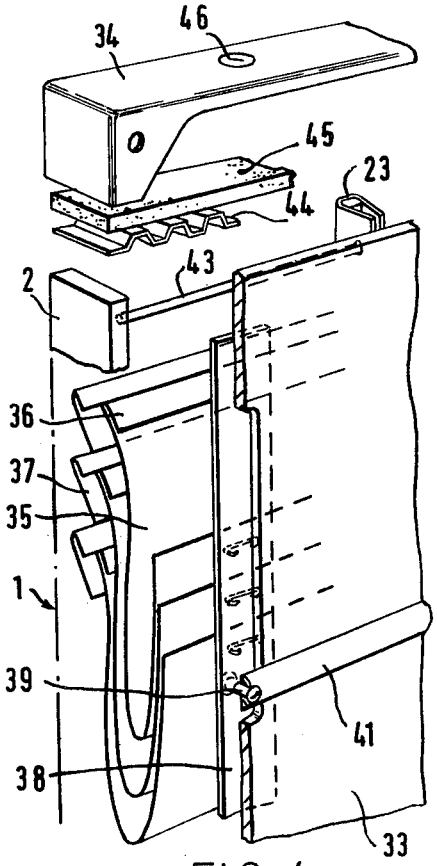
FIG. 4 is a view similar to FIG. 3, but to a larger scale and partly in section, taken from the back of the rack.

FIGS. 3 to 5, in which the same references will be used where appropriate to indicate similar parts, show a modification. In this construction the casing 1 has side walls 2 over which covers (not shown) may be fitted if desired. The top 4 and cover 5 of FIGS. 1 and 2 are, however, replaced by a combined cover and top 34, while the bottom 6 with its cover 7 may also be combined in a single part (not shown). These top and bottom parts may be made of metal or of a moulded plastics material.

The pockets (shown at 35 in FIG. 4) are similar to the pockets 15, but they may be made of a more flexible material, such as fabric or a thinner plastic, and their edges are supported in a different way. The front edges 36, which are folded upon themselves, are gripped by cross-bars 37 the upper edges of which are folded over to grip the material of the pockets; the ends of these bars 17 engage in grooves in the walls 2, by which they are supported. The rear edges of the pockets 35 are secured by staples or other means to vertical members 38 (or to a single plate) which take the place of the frame 17. Pins 39 extend through slots 40 in the back 33 of the casing and connect all the members 38 to a cross-bar 41. This bar can be raised or lowered to adjust the depths of the pockets and scales 42 may be provided on the back 33 to show the depths.

The vertical strips 23 which divide the pockets laterally and which are shown in FIGS. 3 and 4 as being made of metal folded round a rod are, in this construction, slidably mounted on crossrods one of which is shown at 43. The strips 23 can thus be moved laterally to give the required widths to the pockets, any surplus strips 23 being kept at one end of the casing 1.

The strips 23 can be held in their adjusted positions by friction only, but FIGS. 3 and 4 show special means for holding their upper ends in position. These means include a locking member 44 made of a resilient corrugated material, which may be a metal or a plastic. This is pressed resiliently against the upper ends of the strips 23 by a pad 45 made of rubber or the like, which is compressed between the locking member 43 and the top 34.

Instead of or in addition to the pad 45 retaining screws may be used which are screwed in holes 46 in the top 34 and engage the locking member 44. Tightening of these screws locks the strips 23 in the position but they can be freed for adjustment when required.

Figure 6:
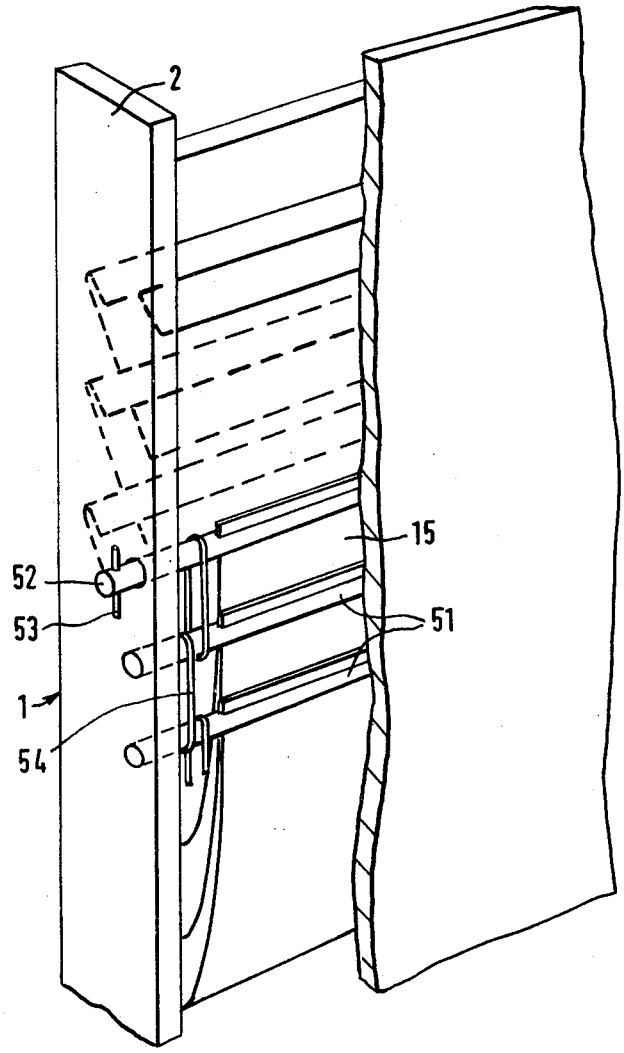
FIG. 6 is a view similar to FIG. 4 but showing another modification.

Other means can also be used for adjusting the depths of the pockets 15. FIG. 6 shows how the rear edge of each pocket 15 may be attached to one of a number of rollers 51 rotatably mounted in the ends 2 of the casing 1. One end 52 of one of the rollers 51 projects outside the casing and carries a bar, knob or the like 53 by which it can be turned. The rollers 52 are connected together by belts 54, which may be of rubber or by other means, so that turning of one roller turns all the others. If desired the rollers 52 could be divided into groups so that the depths of some pockets could be adjusted independently of the others.

Figure 7:
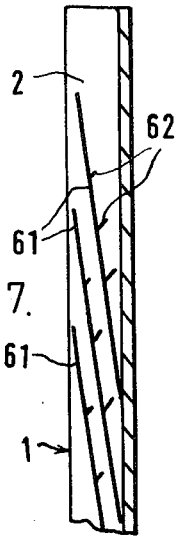
FIG. 7 is a detail sketch view in section showing parts of another modification.
Figure 8:
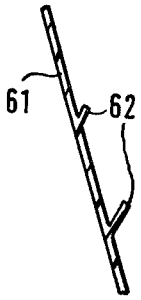
FIG. 8 is a detail sectional view to a larger scale taken through part of the rack shown in FIG. 7.

FIGS. 7 and 8 show a construction with fixed pockets which can be used so that they have different effective depths as required. Instead of forming the pockets of flexible material each pocket has its front formed of a fixed plate 61 which has a plurality of ledges (or other projections) 62 projecting into the pocket. The plates 61, which are inclined to the vertical, are attached at their ends to the ends 2 of the casing 1, which has a fixed back 63. This forms the backs of the pockets and has the lower edges of the plates 61 secured to it. The amount by which the ledges 62 project increases towards the bottoms of the pockets, as shown. This makes it easy, when inserting a card, to cause its lower edge to engage the selected one of the ledges 62.

The plates 61 with their ledges 62 can be made of metal or of a synthetic plastics or other suitable material; if desired the material used could be transparent.

Any desired number of racks may be used together and lugs may be provided projecting from one end of each rack for engagement in slots in the end of the adjacent rack.

Although the racks of the invention will normally be adjusted so that parts of the cards can be seen projecting from the pockets it is possible to use the adjustment of the pockets to lower all the cards so that they are completely hidden when this is desired.

Instead of using fixed ledges or projections 62 (FIGS. 7 and 8) it is possible to provide supports for the lower edges of the cards which are vertically adjustable behind the plates 61, which could then be arranged vertically. Such supports might, for example, be mounted on vertically movable members or on an inner back plate which can be adjusted vertically in a similar manner to the members 38 of FIG. 4.

I claim:

1. A vertical rack for the storage of cards or the like, comprising: a casing, means defining within said casing a plurality of pockets having forwardly facing openings at their upper ends arranged one above the other at the front of said casing and overlapping one behind the other within said casing, each said pocket having a front, bottom and back formed of a continuous sheet of flexible material, means for fixedly supporting front edges of said sheets at a bottom of said pocket openings and means for raising and lowering the rear edges of said sheets to adjust the depths of said pockets whereby the bottom edges of the cards inserted in said pockets are supported by pockets at levels decided by the user.

2. A rack according to claim 1, wherein the rear edges of said sheets are attached to at least one back support member which is movable upwardly and downwardly within said casing to adjust the depths of said pockets.

3. A rack according to claim 1, wherein said raising and lowering means comprise rollers to which said sheets are attached and means for turning said rollers to adjust the depths of said pockets.

4. A rack according to claim 3, wherein the rear edges of said sheets are supported in their adjusted positions by friction between said back support member or members and a back board forming part of said casing.

5. A rack according to claim 1, wherein each said pocket has a fixed back wall and a fixed front wall which slopes downwardly and inwardly from said pocket opening, and wherein each said front wall has a plurality of projections at different levels within said pocket, on selected ones of which projections the bottom edges of cards inserted into said pockets can be engaged to give said pockets the desired effective depths.

6. A rack according to claim 5, wherein the said projections at different levels in a pocket project progressively further into said pocket as they are nearer the bottom thereof.

7. A rack according to claim 1, which also includes a plurality of dividing members the inner edges of which are formed with recesses to receive the front edges of said pockets, and wherein means are provided for supporting said dividing members in said casing at different positions across the width of said casing which are selected by the user according to the number and sizes of the individual pockets required.

8. A rack according to claim 7, wherein said dividing members are slidably mounted on rods extending across said casing.

9. A rack according to claim 7, wherein said dividing members are removable from said casing, into which any desired number of said members can be inserted as needed, and wherein a locking member is provided which engages said dividing members to lock them in position in said casing.

* * * * *